US005220504A

United States Patent [19]

Holzhausen et al.

[11] Patent Number: 5,220,504

[45] Date of Patent: Jun. 15, 1993

[54] EVALUATING PROPERTIES OF POROUS FORMATIONS

[75] Inventors: Gary R. Holzhausen, Salinas; J. Jamie Gomez-Hernandez, Stanford; Gregory S. Baker; Howard N. Egan, both of Santa Cruz, all of Calif.

[73] Assignee: Applied Geomechanics, Santa Cruz, Calif.

[21] Appl. No.: 749,508

[22] Filed: Aug. 16, 1991

Related U.S. Application Data

[63] Continuation of Ser. No. 401,684, Aug. 31, 1989, abandoned.

[51] Int. Cl.[5] ..... G01V 1/00

[52] U.S. Cl. ..... 364/421; 364/422

[58] Field of Search ..... 364/421, 422; 73/155, 73/151; 367/35; 166/308; 181/106, 401

[56] References Cited

U.S. PATENT DOCUMENTS

| | | | |
|---|---|---|---|
| 3,559,476 | 2/1971 | Kuo et al. | 73/155 |
| 3,990,512 | 11/1976 | Kuris | 166/308 |
| 4,102,185 | 7/1978 | Dowling et al. | 73/155 |
| 4,328,705 | 5/1982 | Gringarten | 73/155 |
| 4,339,968 | 7/1982 | Hallmark | 73/155 |
| 4,348,897 | 9/1982 | Krauss-Kalweit | 73/155 |
| 4,427,944 | 1/1984 | Chandler | 324/353 |
| 4,671,379 | 6/1987 | Kennedy et al. | 181/401 |
| 4,677,849 | 7/1987 | Ayoub et al. | 73/155 |
| 4,743,854 | 5/1988 | Vinegar et al. | 364/366 |
| 4,773,264 | 9/1988 | Hervon | 364/422 |
| 4,779,200 | 10/1988 | Bradbury et al. | 364/422 |
| 4,780,857 | 11/1988 | Lyle et al. | 364/422 |
| 4,783,769 | 11/1988 | Holzhausen | 367/35 |
| 4,802,144 | 1/1989 | Holzhausen et al. | 367/35 |
| 4,858,130 | 8/1989 | Widrow | 364/421 |
| 4,869,338 | 9/1989 | Wiggins et al. | 181/106 |
| 4,903,527 | 2/1990 | Hervon | 364/422 |

FOREIGN PATENT DOCUMENTS

| | | |
|---|---|---|
| 2060903 | 5/1981 | United Kingdom . |
| 2161943 | 1/1986 | United Kingdom . |
| 2215462 | 9/1989 | United Kingdom . |

*Primary Examiner*—Gail O. Hayes
*Assistant Examiner*—Xuong Chung
*Attorney, Agent, or Firm*—Skjerven, Morrill, MacPherson, Franklin & Friel

[57] ABSTRACT

The properties of porous material that is hydraulically coupled to a well through openings in cased or in uncased portions of the well are evaluated. The process involves initiating a pressure wave, typically at the well head, so that the pressure oscillations extend to the porous material zone under investigation. Flow of fluid between the well and formation changes the amplitude and frequency content of the oscillations traveling up and down the well. That is, the oscillations are modulated from the form they would have in a like well with no hydraulic communication to the formation. The properties of the formation are derived from these changes.

48 Claims, 13 Drawing Sheets

```
(* Source code comments are placed in brackets *)

(*
  PROCEDURE:  INIT_AQUIFER

  Initializes the following physical parameters which describe the
  aquifer at time zero :
  the initial flow and pressure head,
  the wavespeed in the aquifer,
  the number of elements and nodes in which the aquifer has been divided,
  and the other required constants (S, dx, alphaover2gn, alpha, and W)
*)
procedure INIT_AQUIFER (branch_no: longint);
var i1, junction_no: longint;
                 i: integer;
                h0: real;
begin
  with BRANCH[branch_no] do
  begin
    junction_no := TO_NODE;
    with AQUIFER^ do
    begin
        S := Ss * b;
        a := sqrt(g * n / Ss);
        dx := a * dt;
        nelements := trunc(length / dx) + 1;
        nnodes := nelements + 1;
        h0 := NODE[junction_no].H_JUNCTION;
        for i1 := 1 to nnodes do
        begin
          newH[i1] := h0;
          oldH[i1] := h0;
          newV[i1] := Q0[branch_no] / (2*PI*(wellradius+(nnodes-i1)*dx) *b);
          oldV[i1] := newV[i1]:
          newQ[i1] := Q0[branch_no];
        end;
        alpha:=1;
        alphaaover2gn := (alpha * a) / (2 * g * n):
        W := Kz * dt / (2 * s * m);
      end;
    end;
end;


(*
  PROCEDURE: INIT_FRACTURE

  Initializes the following physical parameters which describe a permeable
  fracture at time zero :
  the initial flow and pressure head,
  wavespeed in the fracture,
  the number of elements and nodes in the fracture,
  and the other required constants (S, dx, drover2k, aover2gn, alpha, area,
                                        W, Kz, dxover2k, aover2gnplus,
                                        aover2gnminus)
*)
procedure INIT_FRACTURE (branch_no: longint);
```

FIG. 10a

```
var
        counter, i : integer;
        i1, junction_no: longint;
        h0: real;
begin
     with BRANCH[branch_no] do
        begin
             junction_no := TO_NODE;
             with FRACUTRE^ do
             begin
                S:= Ss * (2*halfheight);
                a:= sqrt(g * n / Ss);
                dx:= a * dt;
                aovergn := a/(g*n);
                dxover2k := dx/(2*K);
                aovergnplus := aovergn + dxover2k;
                aovergnminus:= aovergn - dxover2k;
                area := PI * halfwidth * halfheight;
                nelements := trunc(length / dx) +1;
                oldnelements := nelements;
                nnodes := nelements +1;
                h0:=NODE[junction_no].H_JUNCTION;
                for i1:=1 to nnodes do
                begin
                   newH[i1] := h0;
                   oldH[i1] := h0;
                   newV[i1] := Q0[branch_no]/area;
                   oldV[i1] := newV[i1];
                   newQ[i1] := Q0[branch_no];
                end;
           end;
     end;
end;


(*
  FUNCTIONS: C1, C2, C3, C4

  These funcitons are all required for the computation of pressure and flow
  inside the acquifer at the next time step.
*)
function C2 (i1: longint): real;
var
     dummy: real;
begin
     with BRANCH(i1].AQUIFER^ do
     begin
        dummy := Ha * (1 - W) + 2 * W * Ho + Va *
                   (alphaaover2gn * (1 + Ra / Rp) = Ra / (2 * K) * ln(Rp/
                    Ra));
           C2 := dummy / (1 + W);
     end;
end;

function C1 (i1: longint): real;
var
     dummy: real;
```

FIG. 10b

```
begin
     with BRANCH[i1].AQUIFER^ do
     begin
          dummy := alphaaover2gn * (1 + Rp / Ra) + Rp / (2 * K) * ln(Rp / Ra);
          CI := dummy / (1 + W);
     end;
end;
function C3 (i1: longint): real;
var
     dummy: real;
begin
     with BRANCH[i1].AQUIFER^ do
     begin
          dummy := alphaaover2gn * (1 + Rp / Rb) + Rp / (2 * K) * ln(Rb / Rp);
          C3 := dummy / (1 + W);
     end;
end;

function C4 (i1: longint): real;
var
     dummy: real;
begin
     with BRANCH[i1].   AQUIFER^ do
     begin
          dummy := Hb * (1 - W) + 2 * W * Ho - Vb * (alphaaover2gn * (1 + Rb /
                                                  Rp)
                                                - Rb / (2 * K) * ln(RB / Rp));
          C4 := dummy / (1 + W);
     end
end;

(*
  FUNCTIONS: C2FRAC, C4FRAC

  These functions are required for the computation of pressure
  and flow inside a permeable fracture during the next time step
*)
function C2FRAC (i1:longint): real;
begin
       with BRANCH[i1].FRACTURE^ do
            C2FRAC := ha + aovergnminus * Va;
end;
function C4FRAC (i1:longint): real;
begin
       with BRANCH[i1].FRACTURE^ do
            C4FRAC := Hb - aovergnminus * Vb;
end;
```

FIG. 10c

```
Calculates the flow and pressure at each node in the aquifer based upon
   the flow and pressure in the previous time step using a solution
   for two-dimensional (radia) flow of a transient
*)
procedure CALCAQUIFER (branch_no: longint):
var
     i1:  longint:
begin
     with BRANCH[branch_no].AQUIFER^ do
     for i1 := 2 to nnodes - 1 do
     begin
          Rp := wellradius + dx * (nnodes-i1);
          Rb := wellradius + dx * (nnodes-i1+1);
          Ra := wellradius + dx * (nnodes-i1-1);
          Ha := oldH[i1 + 1];
          Hb := oldH[i1 - 1];
          Va := oldV[i1 + 1];
          Vb := oldV[i1 - 1];
          Cone := C1(branch_no):
          Ctwo := C2(branch_no);
          Cthree := C3(branch_no);
          Cfour := C4(branch_no);
          Hp := (Cone * Cfour + Ctwo + Cthree) / (Cone + Cthree);
          Vp := (-Ctwo + Cfour) / (Cone + Cthree);
          newH[i1] := Hp;
          newV[i1] := Vp;
          newQ[i1] := Vp * (2 * PI * Rp * b);
     end;
end;


(*
  Calculates the flow and pressure at each node in the fracture based upon
     the flow and pressure in the previous time step using the solution
      for one-dimensional flow of a transient
*)
procedure CALCFRACTURE (branch_no: longint);
var
     i1:  longint;
begin
     with BRANCH[branch_no].FRACTURE^do
       for i1 := 2 to nnodes - 1 do
       begin
            Ha := oldH[i1 + 1];
            Hb := oldH[i1 - 1];
            Va := oldV[i1 + 1];
            Vb := oldV[i1 - 1];
            (* Cone and Cthree are equal to aovergnplus *)
            Cone := aovergnplus;
            Ctwo := C2FRAC(branch_no);
            Cthree := aovergnplus;
            Cfour := C4FRAC(branch_no);
            Hp := (Cone * Cfour + Ctwo * Cthree) / (Cone + Cthree);
            Vp := (-Ctwo + Cfour) / (Cone + Cthree);
            newH[i1] := Hp;
            newH[i1] := Vp;
```

FIG. 10d

```
            newQ[i1] := Vp * area;
        end;
end;


(*
  PROCEDURE: VATBOUNDARY
  Calculates the velocity of fluid flow at the well-aquifer boundary
*)
procedure vatboundary (branch_no: longint);
begin
     with BRANCH[branch_no].AQUIFER^ do
     begin
               Rp := wellradius + dx * nelements;
               Ra := Rp - dx;
               Ha := oldH[2];
               Hp := oldH[1];
               Va := oldV[2];
               newV[1] := (C2(branch_no)-Hp)/C1(branch_no);
               newQ[1] := newV[1] * (2 * PI * Rp * b);

     end;
end;


(*
  PROCEDURE: VATBOUNDARYFRAC

  Calculates the velocity of fluid flow at the well-fracture boundary
*)
procedure vatboundaryfrac (branch_no: longint);
begin
       with BRANCH[branch_no].FRACTURE^ do
               begin
                        Ha := oldH[2];
                        Hp := oldH[1];
                        Va := oldV[2];
                        newV[1] := (C2FRAC(branch_no)-Hp)/aovergnplus;
                        newQ[1] := newV[1] * area;
               end;
end;
```

FIG. 10e

EVALUATING PROPERTIES OF POROUS FORMATIONS

This application is a continuation of application Ser. No. 07/401,684, filed Aug. 31, 1989, now abandoned.

BACKGROUND OF THE INVENTION

1. Field of the Invention

This invention relates to the field of petroleum and ground water engineering. More specifically, it relates to testing of wells in porous formations, including oil wells, gas wells and water wells of all types.

2. Description of the Prior Art

U.S. Pat. Nos. 4,783,769 and 4,802,144, both Holzhausen et al., disclose the use of pressure and flow oscillations for evaluation of the geometry of open fractures and other open fluid-filled conduits intersected by a well bore. These documents do not disclose methods for obtaining properties of porous formations or granular materials. U.S. Pat. No. 4,802,144 discloses a method and apparatus otherwise in several respects analogous to that of the present invention.

U.S. Pat. No. 4,779,200, Bradbury et al., describes a method wherein pressure oscillations are initiated downhole using a drill stem testing (DST) apparatus. These oscillations are then used to evaluate the porosity, permeability or the porosity-permeability product of the subsurface formation adjacent to the DST device.

Bradbury et al. require that the DST device, complete with packer, downhole valve, downhole pressure transducer and downhole flow meter, be lowered on drill pipe to the formation to be tested. This costly requirement limits the usefulness of the invention. Bradbury et al. partially fill a drill pipe with a column of liquid. Bradbury et al. measure pressure downhole only at the DST device and not at the well head, and not at a plurality of points in the well Bradbury et al. also disadvantageously provide a methodology for determining permeability and/or porosity only.

The method of Bradbury et al. investigates only the zone packed off by the DST device. Bradbury et al. interpret only the fundamental frequency of oscillations in the drill pipe. This approach ignores the valuable information contained in higher-frequency oscillations.

U.S. Pat. Nos. 4,783,769 and 4,802,144 disclose the use of inertial effects in interpreting pressure oscillations in well bores intersected by open conduits such as open hydraulic fractures. General mathematical descriptions of wave propagation in fluid-filled pipes are also found in the textbooks of E. B. Wiley and V. L. Streeter, *Fluid Transients*, (FEB Press, 1982) and John Parmakian, *Waterhammer Analysis*, (Dover Publications 1963).

From the above cited sources, it is known that the equation for dynamic force equilibrium in the fluid in the well can be written as:

$$\frac{\partial H}{\partial z} = -\frac{1}{g}\left(\frac{\partial V}{\partial t} + V\frac{\partial V}{\partial z}\right) \quad (1)$$

The equation for continuity in the fluid system can be written as:

$$\frac{\partial H}{\partial t} + V\frac{\partial H}{\partial z} + -\frac{a^2}{g}\frac{\partial H}{\partial z} \quad (2)$$

where V is particle velocity in the fluid, H hydrostatic head, t time, z distance parallel to the axis of the well, a wavespeed in the fluid and g gravitational acceleration.

SUMMARY OF THE INVENTION

In accordance with the invention, a process is provided for testing a well to obtain the properties of the porous rock or soil materials penetrated by the well. Such properties include, but are not necessarily limited to, permeability, porosity, storativity, thickness and pore fluid viscosity. The process in accordance with the invention obtains this information using data contained in pressure and/or flow waves traveling in the fluid in the well. Such waves may be generated impulsively or by using a continuous forcing function Suitable wave generation methods are described elsewhere in this disclosure.

The low cost, speed and reliability with which the required signals can be generated, recorded and interpreted are advantages of the present invention. The process in accordance with the invention provides vital information for profitable well maintenance and repair. It also eliminates most of the expensive "downtime," i.e., the time a well must be out of operation, required by conventional testing methods such as drill stem testing or pressure build-up or fall-off testing.

In accordance with the invention, the fluid in a well is perturbed to create pressure and flow oscillations in the fluid. These oscillations propagate up and down the well as waves traveling at the speed of sound. When the well fluid is hydraulically coupled to fluid in adjacent porous material, the properties of the porous material modulate (change) these oscillations. Coupling can be through holes in the well bore casing or by direct fluid contact in uncased portions of the well. If the geometry of the well and approximate fluid properties in the well are known, the pressure and flow oscillations associated with different sets of formation properties are accurately predicted.

Accurate prediction of pressure and flow oscillations requires that inertial effects in the fluid be taken into consideration. The present invention improves over conventional methods of evaluating formation properties by considering inertial effects.

In summary, the following steps are included in the process in accordance with the invention:

1. Install pressure transducer(s) or flow transducer(s), or both at a single point in the well or at a plurality of points.

2. Connect the transducers to a conventional data recorder capable of resolving the fundamental frequency of the well and higher-order harmonics.

3. Perturb the fluid in the well either impulsively or with a steady oscillatory action (i.e., a forcing function).

4. Measure and record the resulting pressure and/or flow oscillations at the previously installed transducers.

5. Construct a numerical (i.e., mathematical) model of the fluid system that satisfies conditions of mass conservation (continuity) and momentum conservation (dynamic force equilibrium). Incorporate known well properties into the model.

6. Vary formation properties in the model until a match to the measured pressure and/or flow oscillations has been found.

7. Use the porous formation properties in the model that best match the actual data as estimates of the actual formation properties.

The method in accordance with the invention includes solving the governing equations for flow in a well and adjacent formation, including inertial effects. In contrast, Bradbury et al. rely on predetermined closed-form equations to estimate porosity and/permeability only. The disadvantage of the use of closed-form equations by Bradbury et al. is overcome in accordance with the present invention by the application of numerical data fitting techniques.

The data fitting methodology in accordance with the invention overcomes errors inherent in the method of Bradbury et al. when, for example, the fundamental frequency of oscillations is masked-by higher-order harmonics or when other unexpected behavior occurs. The present invention also permits in one embodiment simultaneous evaluation of multiple properties of the formation, such as thickness, porosity and permeability. The present invention also permits multiple formation zones at different depths to be ; evaluated simultaneously.

In addition to evaluating layered rock adjacent to a well bore, the process in accordance with the invention can be used for evaluating the properties of the porous material which fills fractures, conduits and other openings. This capability, along with the inclusion of inertial effects in the fluid system, is an advantage over prior art methods of investigating porous rocks.

An objective of the invention is to overcome disadvantages of the prior art methods that greatly limit their economy and practicality.

A second objective is to provide a method in which no tools or apparatus need be inserted into the well.

A third objective is to provide a method in which the entire well or only a portion of the well may be filled with liquid.

A fourth objective is to evaluate properties in addition to permeability and porosity, such as formation thickness.

A fifth objective is to provide a method which does not use packers, and is capable of simultaneously investigating multiple zones of porous material at different depths.

A sixth objective is to provide a method which uses all of the oscillations measured in a well, including the fundamental oscillation of the well and its higher-order harmonics.

BRIEF DESCRIPTION OF THE DRAWINGS

FIGS. 10*a* to 10*e* show a computer program in accordance with the invention.

Similar reference numbers in various figures denote similar or identical structures.

DETAILED DESCRIPTION OF THE INVENTION

Definitions

The terms "pressure wave", "sonic wave" and "acoustic wave" have similar or identical meanings herein, and refer to a longitudinal wave in the fluid in the well and/or in the fluid in the adjacent porous media. They do not refer to elastic waves in the solid rock or granular matrix or in the well casing itself.

The method in accordance with the invention can be used to evaluate properties of soil or rock, or of porous manmade materials such as fracture propant (a material widely used in oil and gas wells). The term "formation" refers collectively to all of these materials.

"Impulse" refers to a sudden change of pressure or flow conditions at a point in a well, said impulse initiating a pressure wave in the fluid system. Resulting oscillations occur at the resonant frequencies of the well and gradually decay as a result of friction and other energy losses.

"Forcing function" refers to any continuous source of oscillatory pressure and flow. A forcing function typically is a source of steady oscillations, such as a conventional reciprocating pump. Oscillations that result from a steady forcing function occur at the frequency of the forcing function and its associated harmonics. They continue as long as the forcing function is applied.

Wave Propagation in Fluid in Wells and Porous Formations

The method in accordance the present invention treats a fluid-filled well connected to a fluid-filled porous material, such as rock, soil or granular material, as a fluid system. Steady fluid flow, by definition, is accompanied by the time-invariant fluid pressure at all points in the system. For example, a fluid system at rest is at steady, or zero, flow. Excitations that occur slowly relative to the fundamental period of the fluid system induce noninertial pressure variations and do not produce pressure waves in the fluid. However, when the fluid is abruptly disturbed, a period of transient flow results. This transient flow is characterized by the propagation of pressure waves through the system.

Figure 1:
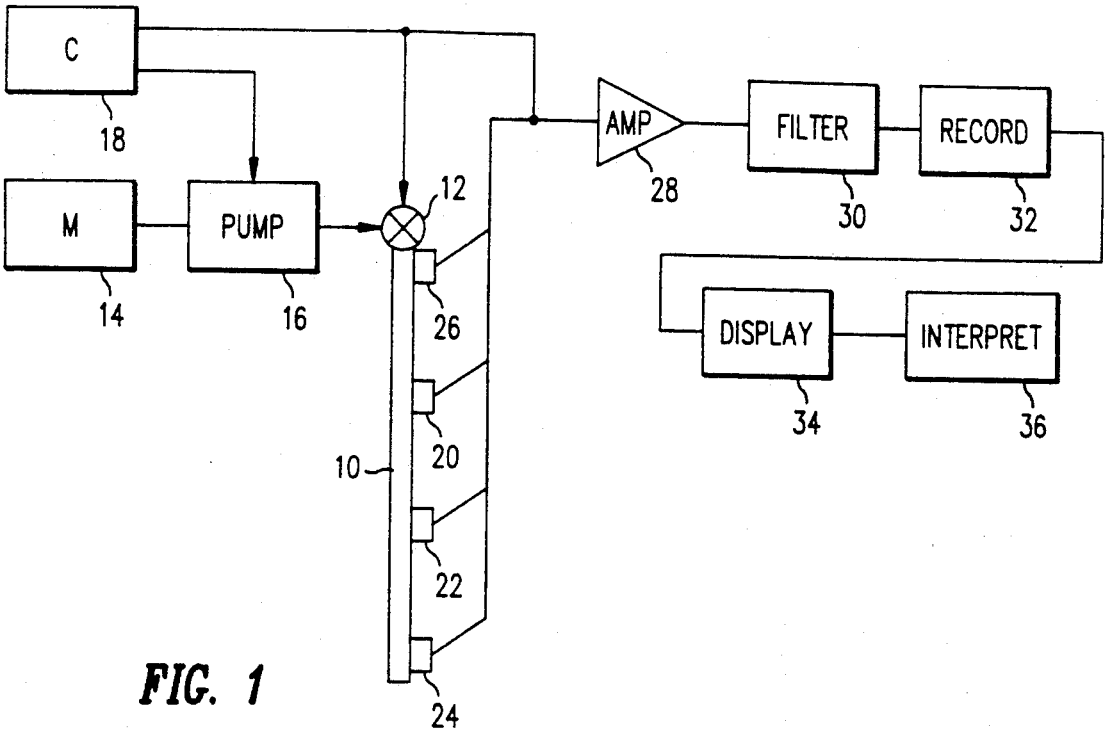
FIG. 1 is a diagram showing in elevation the apparatus and well bore in one embodiment of the invention.

As an example of the generation of pressure and flow oscillations using the inventive method, consider a well 10 (FIG. 1) that has a net positive pressure throughout. The apparatus shown in FIG. 1 is disclosed in U.S. Pat. No. 4,802,144, incorporated herein by reference. Initially the fluid system is at rest. A small volume of fluid is then removed from the well by rapidly opening and closing a valve 12 at the well head. The removal of fluid causes pressure near the valve 12 to drop below pressures elsewhere in the well 10. As fluid from below moves up to replace the lost fluid, pressure at the point from which the fluid came drops below its original value. This process is repeated down the well 10 and, in this manner, a dilatational wave 40 (see FIGS. 2*b*, 3*b*) is propagated from the top 12 to the bottom 36 of the well as shown in FIGS. 2*a* and 3*a*.

Figures 2A, 2B, 2C, 2D:
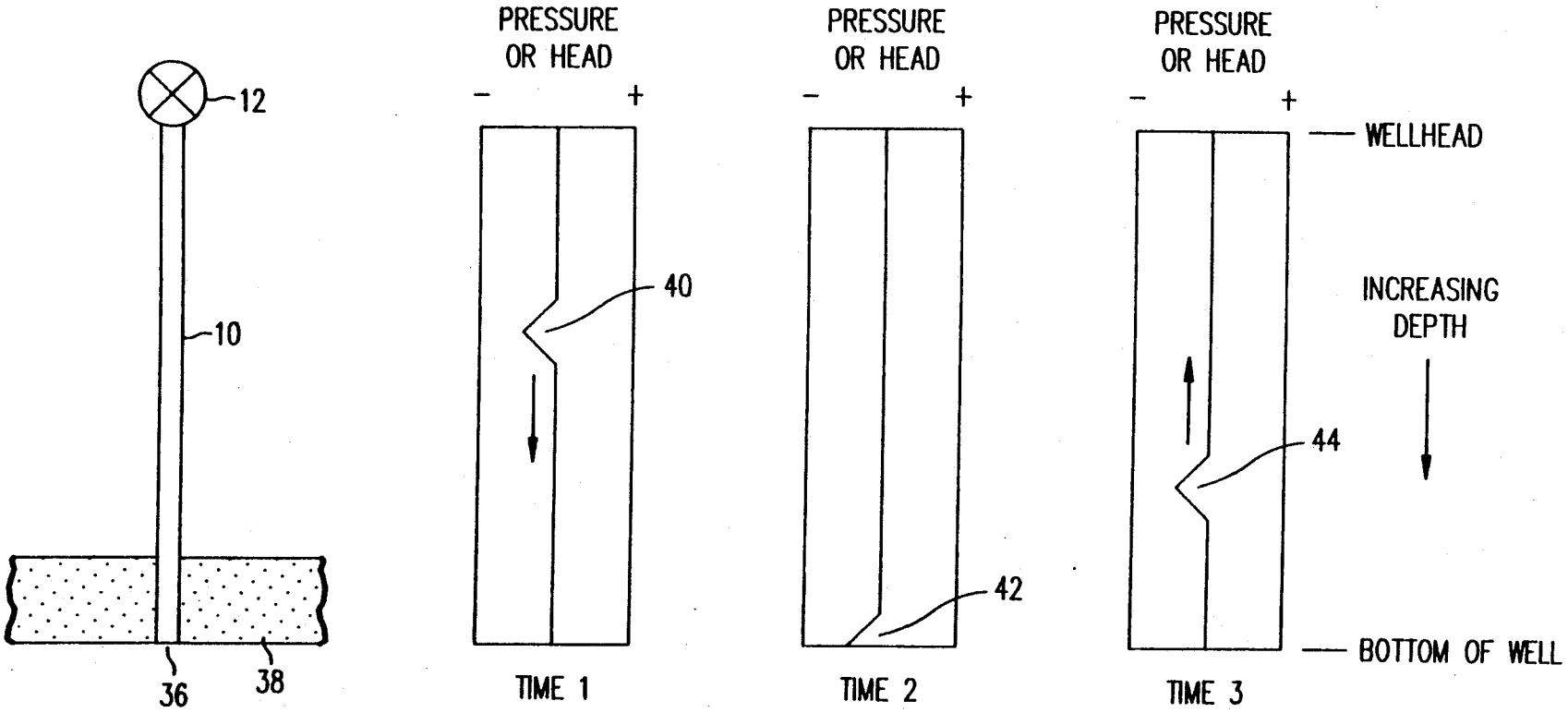
FIGS. 2*a* to 2*d* show wave reflection at the bottom of the well for a very low permeability formation.
Figures 3A, 3B, 3C, 3D:
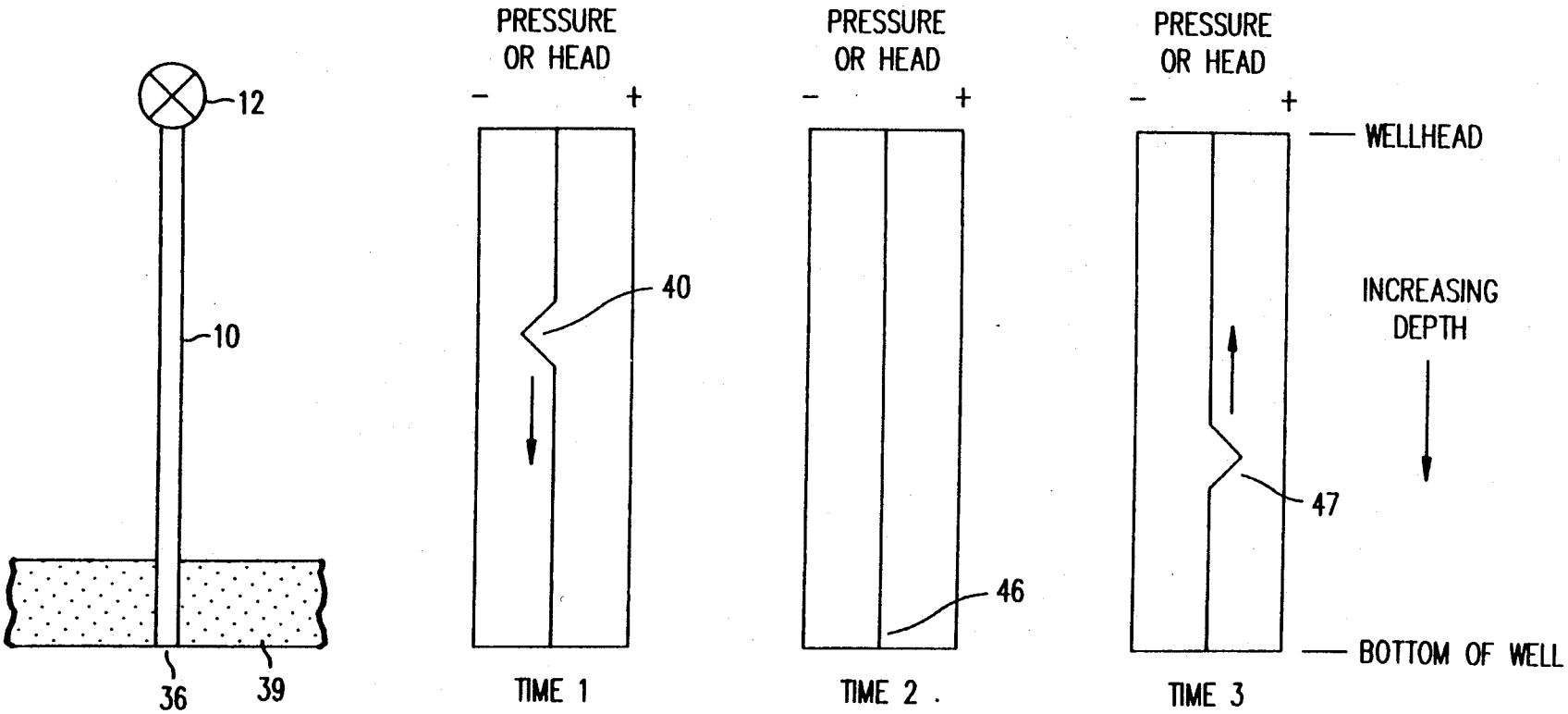
FIGS. 3*a* to 3*d* show wave reflection at the bottom of the well for a formation with very high permeability and porosity.

In both FIGS. 2*a* and 3*a* the porous formation is at the bottom of the well and is assumed to communicate with the well, via perforations or an absence of casing, over the entire formation height. FIGS. 2*b* to 2*d* show three plots of relative pressure or head in the well at different times for a low permeability formation. FIGS. 3*b* to 3*d* show three plots of relative pressure or head in the well at different times for a high permeability formation. The hydrostatic increase of pressure with depth has been removed from the pressure plots. Absolute pressure is positive throughout the well in both FIGS. 2 and 3. The minus sign indicates a lowering of pressure from the initial value. The plus sign indicates a raising of the pressure from the initial value Pressure transducers 26, 20, 22 and 24 (see FIG. 1) detect this wave 40 as it travels from the wellhead to the bottom of the well. When the dilatational wave reaches the depth where the fluid in the well communicates to the fluid in the porous formation (communication may be through perforations or through an uncased portion of the well), fluid in the formation 38, 39 (see FIGS. 2*a*, 3*a*) will flow into the well in response to the local decrease in pressure. In both FIGS. 2*a* and 3*a* this depth interval is at the bottom of the well. However, this process will occur wherever the well fluid communicates to the formation fluid. Such location can be at any depth in the well, or at a plurality of depths in the well.

The amount and rate of fluid flow into or away from the well in response to a particular impulse are functions of the physical properties of the formation, principally permeability, porosity, thickness pore fluid viscosity and storativity. This flow controls pressure wave reflection. For example, when the formation 38 permeability is very low (FIGS. 2*a* to 2*d*), the impulse is reflected with like polarity (i.e., a low-pressure wave is reflected as a low-pressure wave). At the bottom 36 of the well there is a momentary doubling of the amplitude of the wave 42 (FIG. 2*c*) The reflected wave 44 (FIG. 2*d*) then travels back toward the wellhead with the amplitude of the original downgoing wave 40, neglecting friction losses.

When the permeability and porosity of the formation 39 are both very high (FIGS. 3*a* to 3*d*), the downgoing impulse 40 is reflected with opposite polarity (i.e., a low-pressure wave is reflected as a high-pressure wave). In the case of the symmetrical wave 40 shown in FIG. 3*b*, there is an exact cancelling of the wave 46 at the formation 39 at the bottom of the well (FIG. 3*c*) when one half of the wave has been reflected. After reflection is complete, the reflected wave 47 (FIG. 3*a*) that travels back toward the wellhead has the same amplitude but opposite polarity as the original downgoing wave 40, neglecting friction losses. Thus, these examples illustrate that formation properties change, or modulate, the wave that is reflected back toward the wellhead.

The method as described above is effective for both dilatational and compressional waves initiated at the well head. If the initial perturbation of the fluid system adds fluid or compresses fluid already in the well, a compressional wave is propagated. When this wave reaches the part(s) of the well in hydraulic communication to the formation, fluid is forced into the porous material as a result of the local pressure gradient. As in the dilatational case, the frequency and amplitude content of the wave in the well is modulated, providing information for evaluation of formation properties.

The waves that are reflected upward from the bottom of the well and from the contact with the porous formation pass transducers 24, 22, 20 and 26 (FIG. 1) on their way back to the wellhead. In accordance with the present invention, these transducers measure and reveal pressure wave behavior during all passages of waves up and down the well through the well fluid. Although a plurality of transducers reveals additional detail about wave behavior, the inventive method can be performed with only a single transducer. This single transducer is most conveniently placed at the wellhead.

The foregoing discussion described pressure waves generated by an impulsive source. In accordance with the present invention, pressure waves may be generated with a continuous source of oscillations, or forcing function, such as a reciprocating pump at the wellhead. Using for example the motor 14 (see FIG. 1) and pump 16 controlled by control system 18, oscillations can be generated at a plurality of frequencies or over a preselected continuous spectrum of frequencies. Valve 12 is left open during this process of forced oscillation. One or more of the transducers 26, 20, 22 and 24 are used to detect the pressure oscillations in the well in response to said forced oscillation process. As in the above case of impulsively generated pressure oscillations, the oscillation pattern in the well will be modulated by wave interaction with the porous formation.

When an impulsive source is used, the interpretation step includes simulating the amplitudes, frequencies and decay rates of the resulting oscillations. When a forcing function source is used, the frequencies equal the forcing function frequencies and the decay rate is zero. In this embodiment the amplitude of the oscillations is simulated as a function of frequency. It is also possible to simulate oscillation phase differences when the forcing function embodiment is used.

The wave pattern detected by pressure sensors at the wellhead or elsewhere in the well will be different when a porous formation is present than when no porous formation communicates hydraulically with the well. For a given well geometry and fluid in the well, there is a distinct pressure wave pattern associated with each possible set of formation properties and with each possible impulse or forcing function. Therefore, in accordance with the present invention, by proper analysis of oscillations, wave pattern or pressure history set up by creation of an oscillation condition in the well bore connected to a porous formation, the properties of the porous formation may be measured. The wave pattern itself may be measured using a plurality of sensors 20, 22, 24, 26 located at varying points in the well or sensor 26 located at the wellhead. The outputs are conventionally amplified 28, filtered 30 when necessary to remove noise, recorded 32 and displayed 34 for analysis. Any of several well known signal processing techniques for noise suppression may be used when filtering the data. Interpretation 36 consists of determining the properties of the subject formation(s) using the modeling and estimating method in accordance with the invention.

If the well geometry is known or can be approximated, pressure and flow oscillations resulting from a particular impulse or forcing function are calculated in the simulation step. Measured oscillations are then compared with predictions of oscillations for different formation properties, and the set of formation properties that best explains the observed behavior is determined. In making these calculations the equations of motion and of continuity are satisfied throughout the fluid system (see equations 1 and 2). Satisfaction of these equations ensures that fluid is neither lost nor created within the system (continuity condition) and there is dynamic force equilibrium within the system (equation of motion).

The inclusion of inertia by way of the force equilibrium condition in the process is thus an improvement over the conventional methods of evaluating porous formations (e.g., as disclosed in U.S. Pat. Nos. 4,328,705 and 4,779,200) in which inertia is ignored.

An element of the process in accordance with the invention is the application of mathematical expressions for inertial flow in porous formations. These expressions include the governing differential equations for flow in a porous formation and a new boundary condition at the junction between a well and a porous formation. The preferred embodiment of the invention uses these expressions to couple flow in a formation to oscillatory flow in a formation. These novel features are explained as follows.

Figure 4:
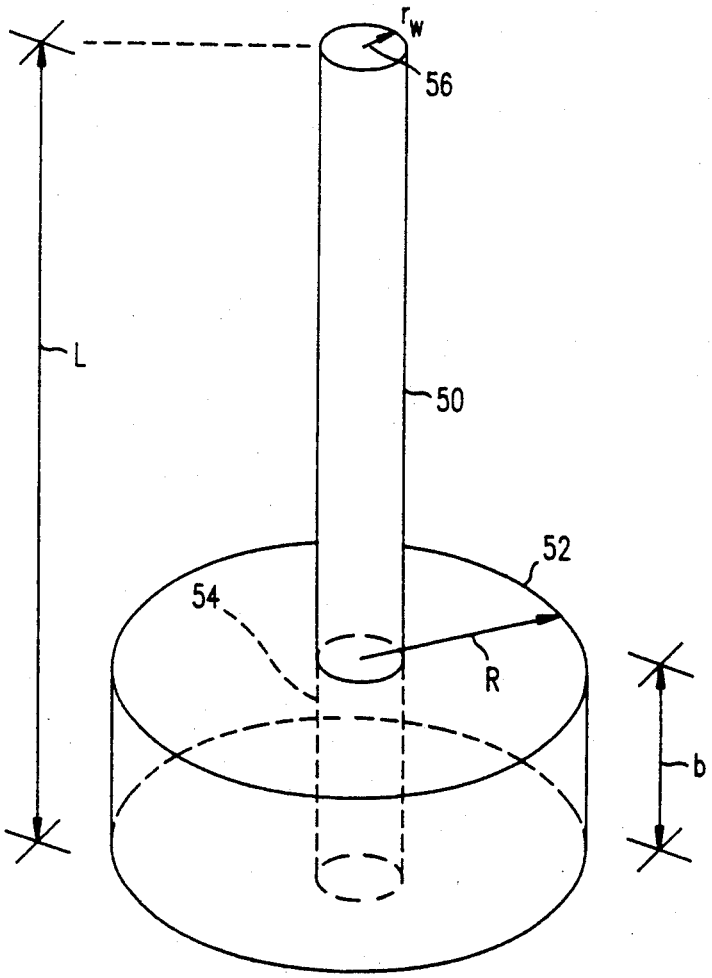
FIG. 4 shows a typical geometry for modeling a layered porous formation.

A completely saturated elastic porous medium is modeled in the well 50 by a cylinder 52 of radius R and constant thickness b (FIG. 4). It is assumed that the porous medium 52 is homogeneous, isotropic and confined between two impermeable beds (not shown). Under these conditions, flow of a homogeneous compressible liquid away from the well is governed by the following partial differential equations:

$$\frac{1}{g\phi}\frac{\partial V}{\partial t}+\frac{V}{K}=-\frac{\partial H}{\partial r} \quad (3)$$

$$\frac{\partial V}{\partial r}+\frac{V}{r}=S_s\frac{\partial H}{\partial t} \quad (4)$$

where f is the radial distance from the center of the well 50, t is time, g is the acceleration due to gravity, $\phi$ is porosity, V is the Darcy velocity (the actual liquid velocity is $V/\phi$), H is the hydraulic or piezometric head, K is the hydraulic conductivity (related to the permeability k by the expression $K=kg/v$, where v is the kinematic viscosity) and $S_s$ is the specific storage S/b, where S is the storativity (storage coefficient). Equation (3) is an extended version of Darcy's law in which the first term represents the effect of acceleration of the fluid inside the porous formation. The inclusion of this acceleration term signifies a major departure from the classical modeling of flow in porous media. This term has to be included in the model due to the special flow conditions being simulated. Equation (4) is the equation of continuity or conservation of mass.

In a preferred embodiment of the invention, the initial conditions are: no flow in the system, and hydraulic heads associated with the no-flow situation as follows:

$$V(r,0)=0,\quad H(r,0)=H_{static}$$

where V(r,0) and H(r,0) are the fluid velocity and hydraulic head in the porous formation at location r and time 0.

The boundary condition at the well/formation interface 54 represents continuity of flow:

$$V_w(L,t)\cdot\pi r_w^2=V(r_w,t)\cdot 2\pi r_w b$$

where $V_w(L,t)$ is the fluid velocity in the well 50 at its bottom at time t, $r_w$ is the well 50 radius and $V(r_w, t)$ is the fluid velocity in the porous formation 52 at the well/formation interface 54. L is distance from the wellhead 56 (or some other reference point) to the center of the porous formation 52 (FIG. 4).

The other boundary condition is set at a distance R sufficiently far from the well 50 such that it does not influence the flow behavior near the well. A constant head boundary (equal to the initial head value) is adopted:

$$H(R,t)=H_o$$

where $H_o$ is the initial head and H(R,t) is the head in the formation 52 at a distance R from the center of the well 50 and at time t. These boundary conditions are illustrative and not limiting.

The formation 52 specific storage $S_s$ is the volume of fluid that can be extracted or added per unit volume of the formation per unit change in head. It is found from the relations:

$$a=\sqrt{\frac{g\phi}{S_s}}$$

and $$S_s=\rho g[\alpha(1-\phi)+B\phi]$$

where $$\alpha=\frac{1}{1-\phi}\frac{\partial\phi}{\partial P}$$

Figure 5:
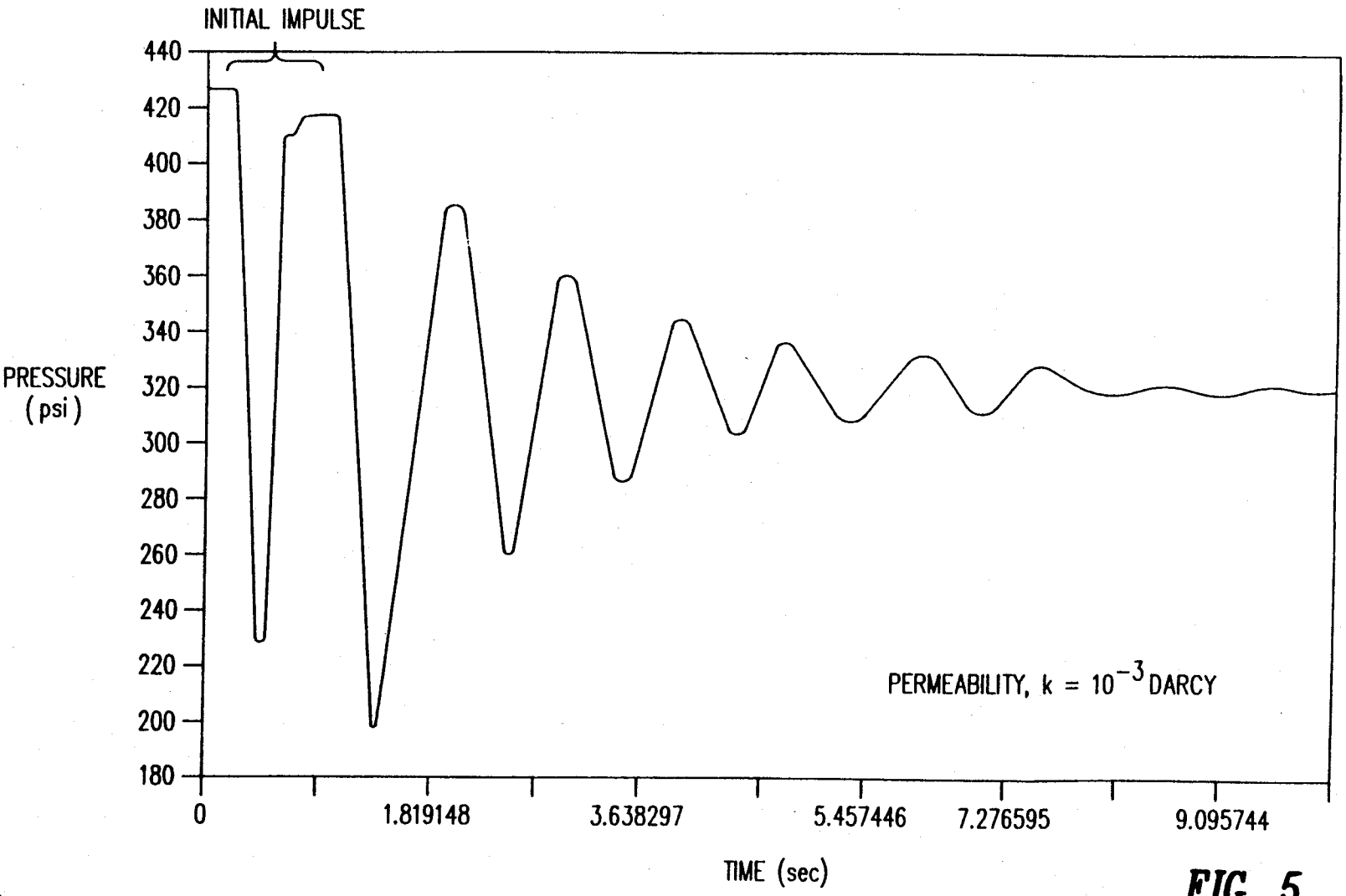
FIGS. 5, 6 and 7 show representative pressure oscillations at the well head for the general case depicted in FIG. 4 for different sets of formation properties.
Figure 6:
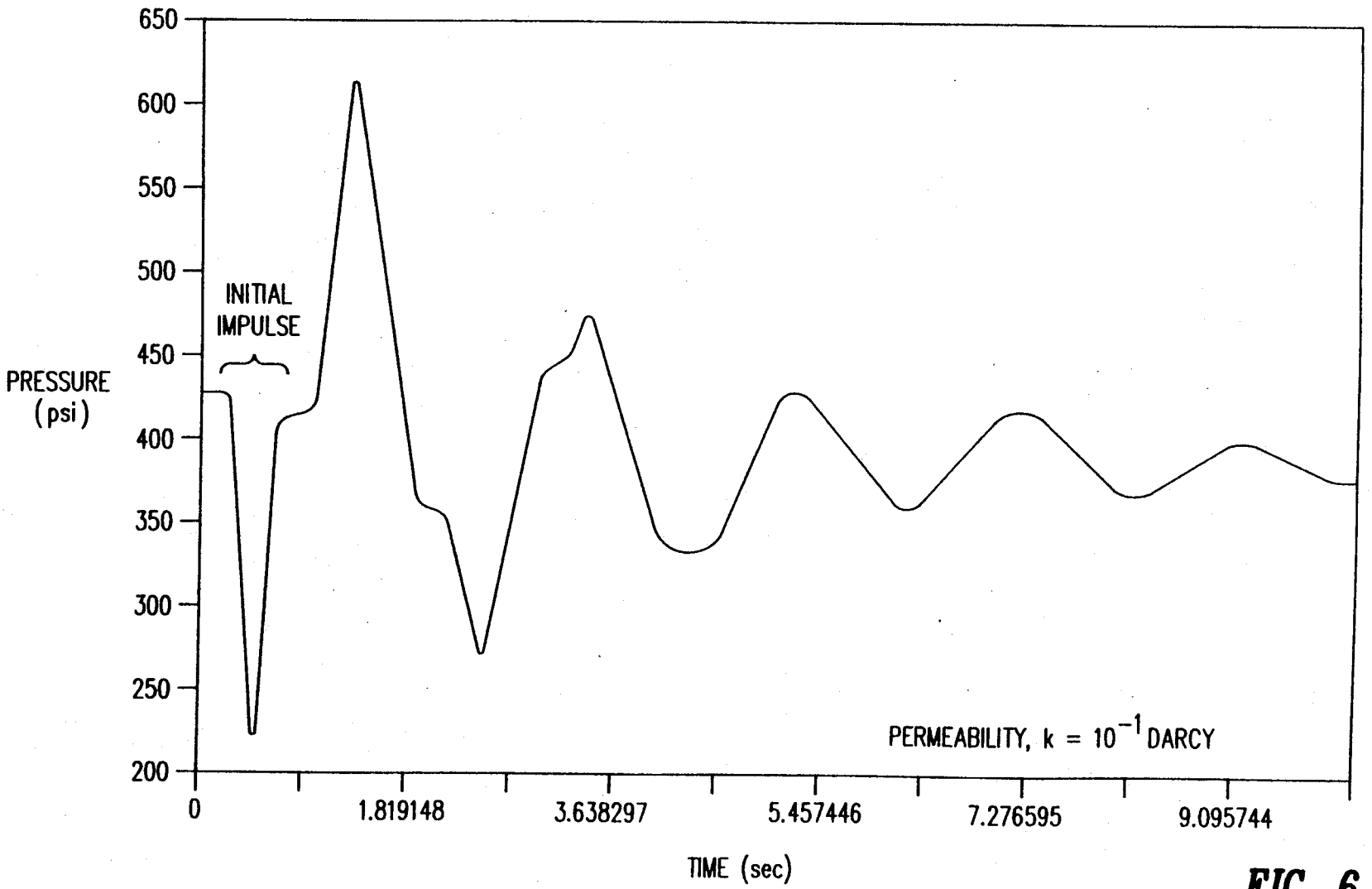
Figure 7:
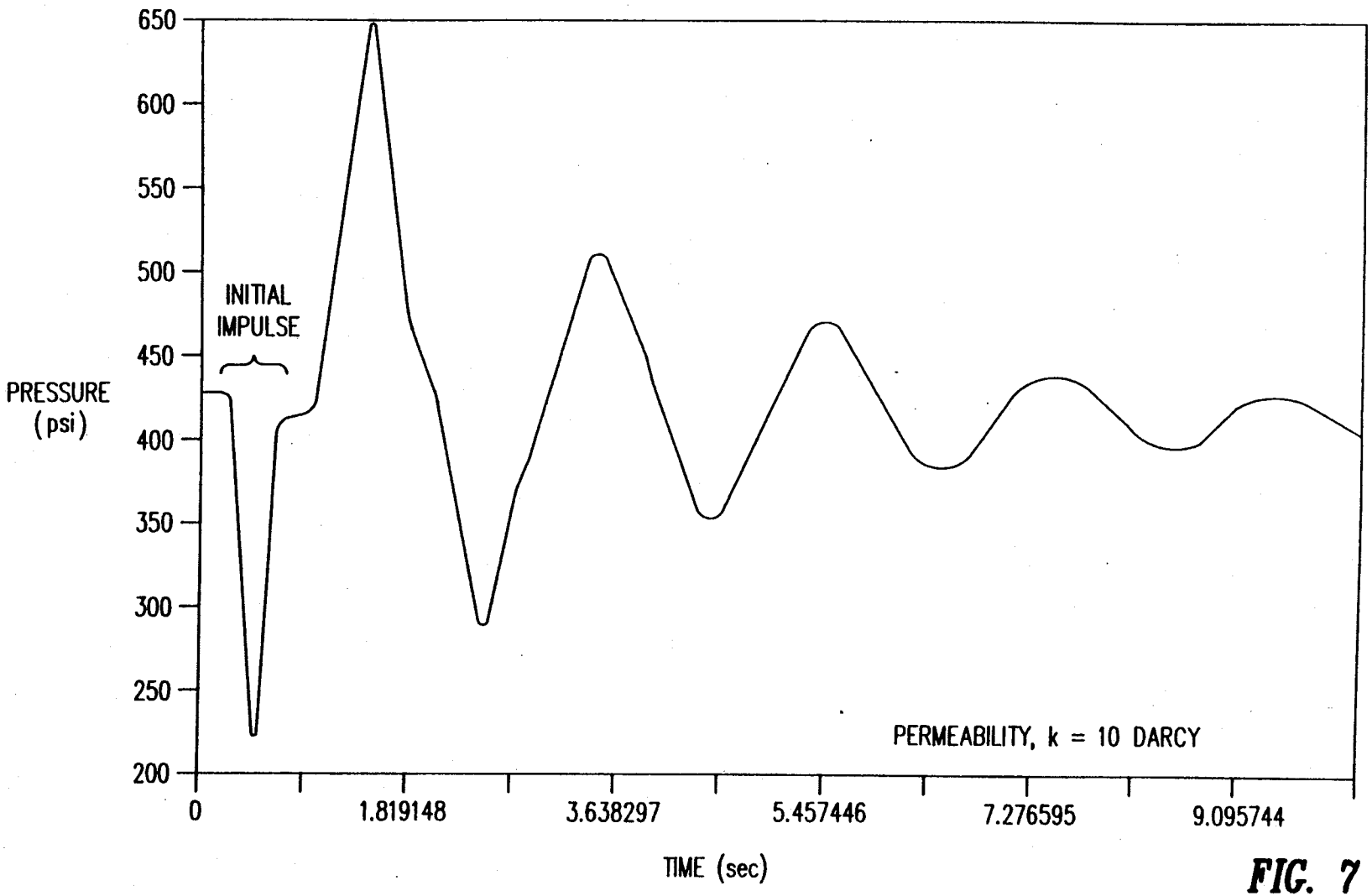

$\phi$=Formation porosity, dimensionless
B=Compressibility of fluid in the formation in units of 1/pressure
a=Wavespeed in the formation
g=Acceleration of gravity
P=Pressure To illustrate the sensitivity of the inventive method to changes in formation properties, well head pressure oscillations in response to an initial impulse were calculated for different combinations of porosity and permeability for the formation 52 geometry shown in FIG. 4. These oscillations are plotted in FIGS. 5, 6 and 7. FIGS. 5, 6 and 7 show the striking differences that result from low- (FIG. 5), moderate- (FIG. 6) and high-permeability (FIG. 7) formations when porosity is 20 percent. For computational purposes, a constant pressure boundary in the formation was set at a radius of 100 feet from the well. Other constants used in the calculation the pressure oscillations of FIGS. 5, 6 and 7 are:

| | |
|---|---|
| well depth, L | 2000 ft. |
| well diameter, $2r_w$ | 5 inches |
| fluid viscosity | 1 centipoise |
| formation height, b | 30 ft. |
| specific storage, $S_s$ | $10^{-6}$ ft$^{-1}$ (typical sandstone) |

The differences in the oscillation patterns evident in FIGS. 5, 6 and 7, each of which represents a different formation permeability, are evidence of the method's sensitivity.

Figure 8:
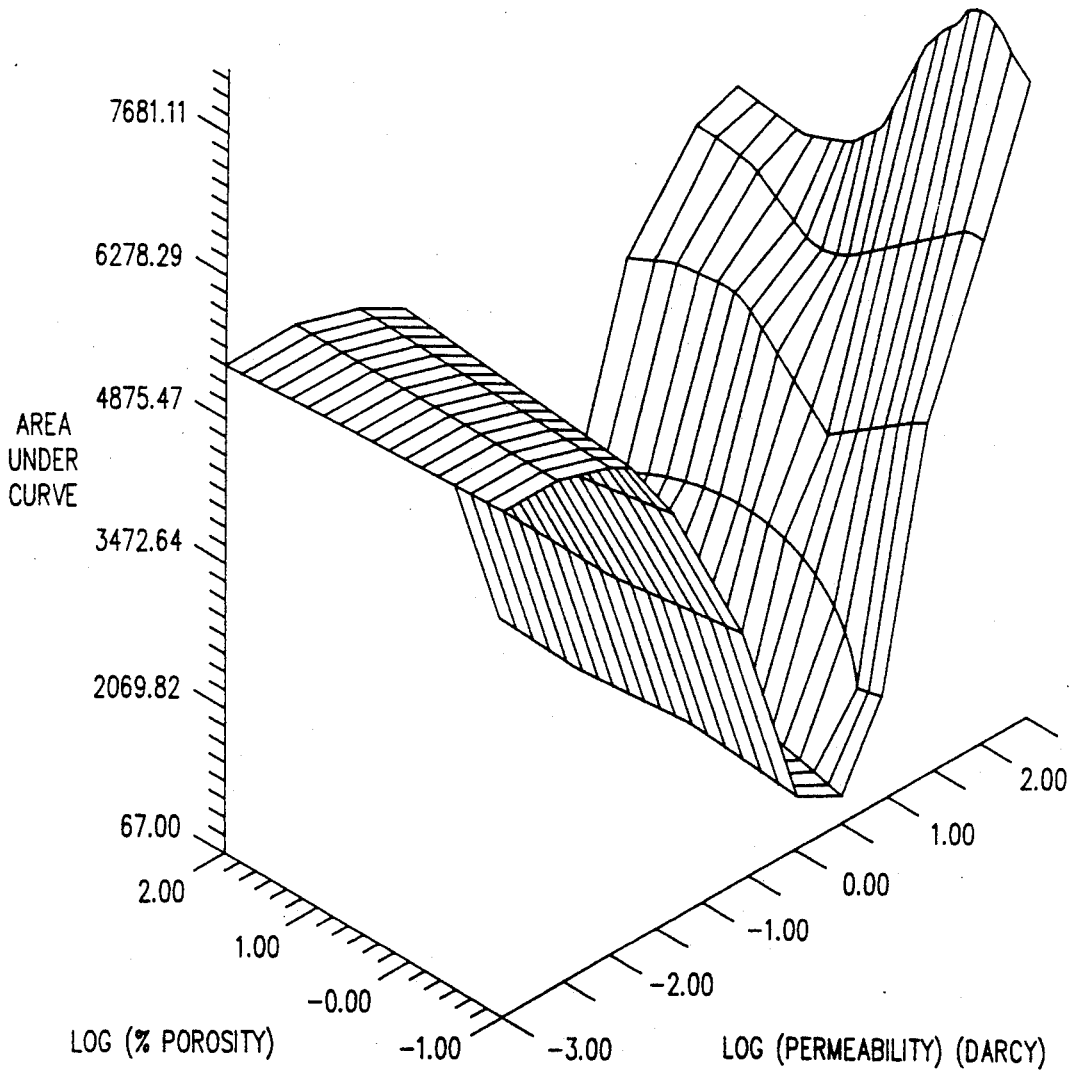
FIG. 8 shows the sensitivity of the method in accordance with the invention to changes in formation porosity and permeability.

FIG. 8 shows the sensitivity of the method in accordance with the invention over a wide range of permeabilities and porosities. To produce FIG. 8, oscillations in a well with the above characteristics were calculated for numerous combinations of formation permeability and porosity. For each combination, the area between the oscillatory pressure curve and a straight line representing the initial pressure was computed. This area is shown in FIG. 8 as the vertical height of the grid intersection points. As the porosity and permeability change (FIG. 8), the area under the curve also changes, thus illustrating the sensitivity of the method. Under the conditions represented by FIG. 8, sensitivity to permeability is greater than sensitivity to porosity.

Although the preceding examples explain the sensitivity of the method to porosity and permeability differences, pressure and flow oscillations are sensitive to each of the formation properties in the hydraulic model of the formation. These properties also preferably include formation thickness and storativity, and pore fluid viscosity. Like porosity and permeability, these properties can be evaluated in accordance with invention.

While the above discloses a method relating to porous layers that intersect the well, the method in accordance with the invention is not restricted to this condition. The invention in other embodiments also enables the evaluation of the properties of porous bodies of other shapes and configurations. In such cases, nonradial flow conditions exist in the porous material intersected by the well. For example, the porous properties of a tube or a fracture filled with granular material can be evaluated. Such a fracture could be natural or could be a closed manmade fracture filled with propant. The following example is for transient flow from the well into a fracture filled with propant (or any other porous material).

A similar approach to the one used to simulate flow into a porous formation is used to simulate flow into a fracture 62 (see FIG. 9) filled with propant (not shown). One difference with the previous case of FIG. 4 is that here flow is modeled as one dimensional, whereas in the layered formation flow is radial and two dimensional.

Assuming that the propant filling the fracture 62 is homogeneous and isotropic, and assuming also that the fracture 62 has a constant cross-sectional area A for its entire length L, and that it is surrounded by impermeable material 66, flow of a homogeneous compressible liquid (not shown) away from the well 68 is governed by the following partial differential equations:

$$\frac{1}{g\phi}\frac{\partial V}{\partial t}+\frac{V}{K}=-\frac{\partial H}{\partial x} \quad (5)$$

$$\frac{\partial V}{\partial x}=S_s\frac{\partial H}{\partial t} \quad (6)$$

where x is the distance from the center of the well 68 to a point 70 in the fracture 62.

The initial conditions are: no flow, and initial head equal to the static head:

$$V(x,0)=0,\quad H(x,0)=H_{static}$$

and the boundary conditions are: continuity of flows at the well/fracture interface 72:

$$V_w(L,t)\cdot\pi_w^2=V(r_w,t)\cdot A$$

and no flow at the tip 74 of the fracture:

$$V(L_f,t)=0.$$

These boundary conditions and governing equations are used in accordance with the inventive method to predict pressure oscillations at any point in the well. Measured. oscillations are then compared to predicted oscillations to determine the properties of the porous material in the fracture. These boundary conditions and geometry are a specific example of the application of the inventive method. The method can be used to evaluate a wide variety of porous bodies under radial, one-dimensional or three-dimensional flow conditions and is not limited by the examples above. For example, nonplanar fractures, biwinged fractures and irregular tubes can also be evaluated.

Figure 9:
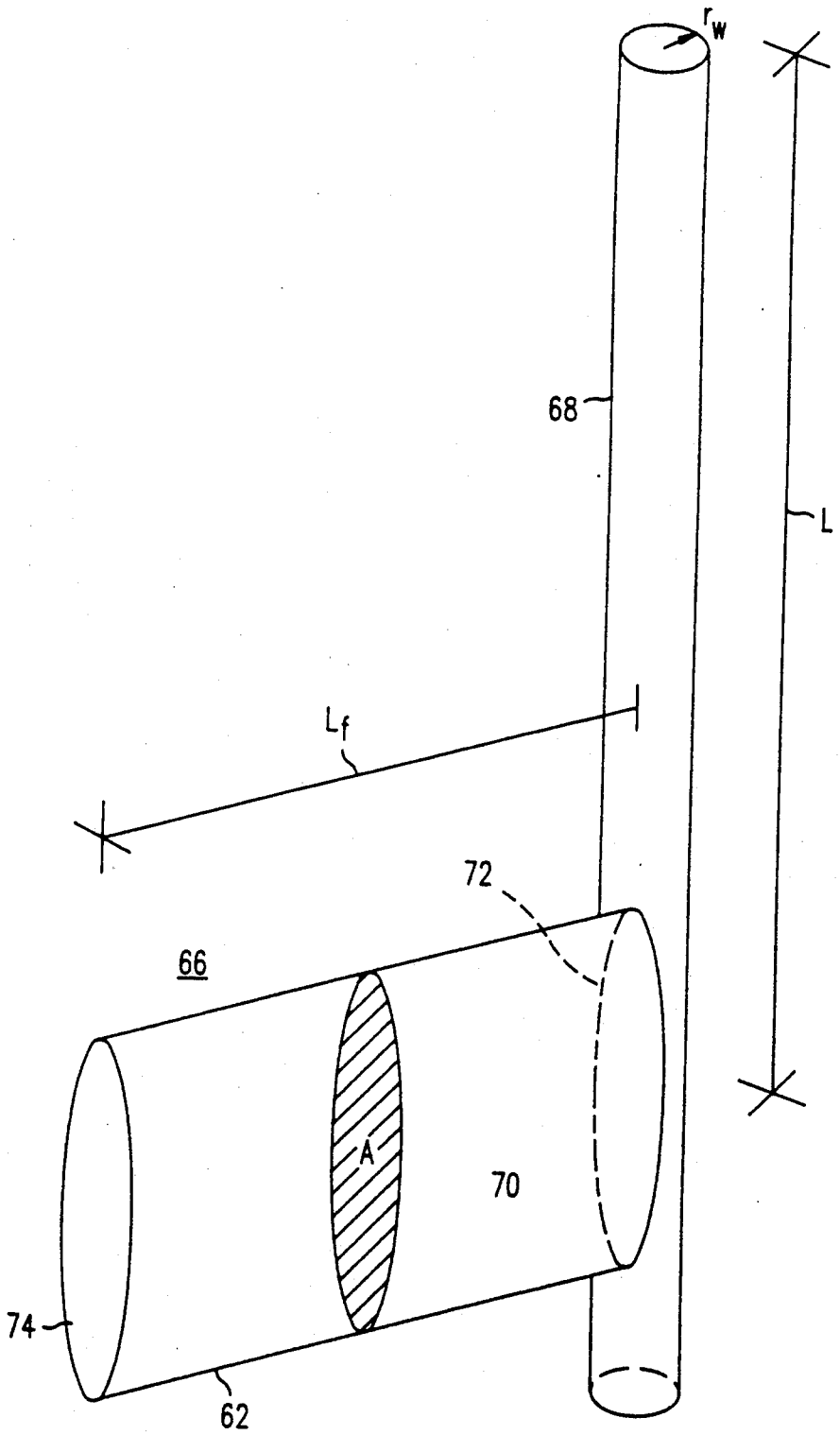
FIG. 9 shows a typical geometry for modeling a propant-filled fracture.

Computer program subroutines that calculate pressure and flow oscillations in formations with geometries shown in FIGS. 4 and 9 are shown in FIGS. 10*a* to 10*e*. These subroutines were used in calculation of the pressure behavior illustrated in FIGS. 5, 6, 7 and 8. When coupled to a conventional numerical model of a well using the boundary conditions given above, these subroutines provide the information necessary to compute pressure and flows in the well. Numerical techniques for modeling hydraulics in pipes (wells) are given in the textbook of Wiley and Streeter, cited above.

Matching Calculated Oscillations to Measured Oscillations

At least two basic approaches are used to compare measured and calculated pressure or flow oscillations and thereby derive formation properties from the measurements. Analogous approaches are described in U.S. Pat. No. 4,802,144, cited above. The first approach is to construct a numerical model of the well and formation using the known impulse or forcing function and all of the known properties of the well, such as depth, diameter, fluid viscosity, fluid wavespeed in the well, etc. Estimates of formation properties are put into the numerical model. Pressure and flow oscillations are then calculated and compared to actual measured oscillations. Formation properties are then changed and new calculated oscillations are compared to the actual measurements. This process of comparison, known as "forward model approximation," is continued until the best fit to the actual data has been found. The more comparisons, the better the fit. Formation properties yielding the best fit are taken as best estimates of the actual properties of the formation.

In practice, forward model approximation can be time consuming because of the many comparisons required to exhaustively search the range of possible formation properties. For this reason, a technique called "inversion" is preferred. Inversion also relies on a hydraulically accurate numerical model of the well and formation. Additionally, inversion uses optimization techniques to rapidly converge on the set of formation properties that best fits the actual data. With inversion, a plurality of formation properties are derived from the data simultaneously. Inversion techniques for data interpretation are well known in the art (e.g., Bevington, P. R., *Data Reduction and Error Analysis for the Physical Sciences*, McGraw-Hill Book Co., San Francisco, 1969).

Generation and Recording of Pressure Oscillations

Constant flow conditions in a well (e.g., no flow or constant flow rate) can be perturbed impulsively or with a steady oscillatory source (forcing function). An example of an impulsive disturbance is rapidly opening and closing a bleed-off valve on a pressurized well. The impulsive source excites free oscillations in the well at its fundamental resonant frequency and attendant harmonics. An example of a forcing function is the periodic action of a reciprocating pump, which excites forced oscillations. The forcing function applies a steady source of oscillations at a controlled frequency. The many resonant frequencies of the well, modulated by the porous formations that intersect it, can be determined by slowly sweeping the forcing function over a bandwidth that includes the fundamental frequency of the well and several higher-order harmonics. A plot of pressure oscillation amplitude versus frequency reveals peaks at the resonances of the well. This spectrum may be interpreted using the governing equations and boundary conditions described herein. Descriptions of the generation of free and forced oscillations in a well are also found in U.S. Pat Nos. 4,802,144 and 4,783,769.

It is most convenient to produce pressure and flow oscillations by perturbing the fluid at the well head (as shown in FIGS. 2 and 3). However, perturbation can be at any point or at a plurality of points in the well according to the invention.

Pressure can be measured at any point in the well, or at a plurality of points, according to the inventive method. Normally, pressure measurement at the well head is preferred to provide convenience and economy. Pressure transducers and recording apparatus should have a bandpass sufficient to measure and record the fundamental frequency of the well and the second harmonic. Conventional transducers and recorders that respond fast enough to capture the ninth, tenth and higher-order harmonics are preferred.

The inventive method in one embodiment uses flow measurements instead of pressure measurements. A combination of pressure and flow measurements may also be used.

Other embodiments of the present invention will be apparent to one skilled in the art in light of this disclosure. For example, porous bodies of shapes or depths other than those in the specific examples described above can be investigated. Similarly, other methods of perturbing the fluid may be used, such as introducing an air gun, water gun, explosive source, pump or the like into the well bore to produce pressure waves. The invention is therefore to be limited only by the claims that follow.

We claim:

1. A method of determining properties such as permeability, porosity, storativity, thickness, and pore fluid viscosity of a porous material intersected by a well bore, comprising the steps of:

abruptly perturbing fluid in the well bore from a head of the well bore so as to induce inertial oscillations in a fluid in said well bore that propagate at the speed of sound in the fluid, said inertial oscillations extending from the head of the well bore, measuring resulting inertial oscillatory behavior at at least one point in the well bore, and evaluating at least one such property of the porous material from the measured inertial behavior.

2. A method as in claim 17, wherein said evaluating step comprises:

calculating theoretical oscillations that would result at the at least one point from the step of perturbing, and comparing the measured oscillatory behavior with the theoretically calculated oscillations to estimate the properties.

3. A method as in claim 2, including the step of determining changes of properties of the porous material by the repeated application of the method of claim 4.

4. A method as in claim 2, wherein the theoretical oscillations are calculated for a variety of reasonable properties of the porous material, and the combination of properties which yields pressure or flow oscillations most closely resembling the measured oscillatory behavior is selected as the best approximation of the true properties of the material.

5. A method as in claim 4, including the step of determining a change of properties of the material by repeated application of the method of claim 4 and comparing the estimated properties of the material with the measured.

6. A method as in claim 1, said inertial oscillations extending to the bottom of said well bore.

7. A method as in claim 1, wherein the evaluating step includes the step of determining the wave speed and viscosity of the fluid.

8. A method as in claim 1, wherein the induced oscillations are caused by rapidly removing a slug of the fluid from the well bore.

9. A method as in claim 1, wherein the induced oscillations are caused by rapidly injecting a slug of the fluid into the well bore.

10. A method as in claim 1, wherein the inertial oscillations are caused by oscillatory action of reciprocating pumps.

11. A method as in claim 1 including the step of measuring transient fluid behavior at the head of the well bore.

12. A method as in claim 1 including the step of measuring transient fluid behavior in the well bore.

13. A method as in claim 1, wherein the inertial oscillations extend to the bottom of the well bore.

14. A method as in claim 1 wherein said oscillations include pressure oscillations.

15. A method as in claim 1, wherein said oscillations include flow oscillations.

16. A method as in claim 1, wherein said oscillations include pressure and flow oscillations.

17. A method as in claim 1, wherein no tools are lowered into the well bore.

18. A method as in claim 1, wherein in the step of measuring, all measurements are made at a surface of said well bore.

19. A method as in claim 1, further comprising the step of providing a source of oscillations at a surface of the well bore.

20. A method as in claim 19, wherein the source is impulsive.

21. A method as in claim 19, further comprising the step of providing a source of steady oscillations.

22. A method as in claim 19, further comprising the step of providing a plurality of sources of oscillations within the well bore.

23. A method as in claim 1, wherein the porous material comprises a sedimentary rock.

24. A method as in claim 1, wherein the porous material comprises a plurality of layers of sedimentary rock intersected by the well.

25. A method as in claim 1, in which said at least one property of the porous material is permeability.

26. A method as in claim 1 in which said at least one property of the porous material is porosity.

27. A method as in claim 1 in which said at least one property of the porous material is storativity.

28. A method as in claim 1 in which said at least one property of the porous material is thickness.

29. A method as in claim 1, in which said at least one property of the porous material is pore fluid viscosity.

30. A method as in claim 1, in which a plurality of properties are evaluated.

31. A method as in claim 1 wherein said step of calculating comprises the steps of:

calculating theoretical oscillations that would result from a combination of properties of the porous material, and comparing the measured pressure oscillations with the theoretically calculated oscillations to estimate a property of the porous material.

32. A method as in claim 31, further comprising the step of comparing the properties over a period of time to detect changes in the porous material.

33. A method as in claim 1, wherein the porous material includes a fracture filled with porous granular material.

34. A method as in claim 1, wherein the porous material is at least one natural opening filled with porous granular material.

35. A method as in claim 1, in which the porous material includes at least one manmade opening filled with porous material.

36. A method as in claim 1, in which the porous material includes soil.

37. A method as in claim 1, wherein the step of evaluating takes into account inertial effects in the fluid.

38. A method as in claim 1, wherein the step of evaluating comprises the step of simultaneously evaluating multiple properties of the porous materials.

39. A method as in claim 1, wherein the step of measuring comprises the step of measuring a fundamental and at least one higher order harmonic of the oscillatory behavior.

40. The method of claim 1, wherein the inertial oscillations are transient.

41. The method of claim 1, wherein the perturbing step comprises using a steady forcing function swept over a plurality of frequencies, thereby inducing undamped pressure oscillations.

42. The method of claim 1, wherein the step of evaluating includes determining at about the same time properties of a plurality of porous materials each located at a different depth in the well bore.

43. An apparatus for determining properties such as permeability, porosity, storativity, thickness, and pore fluid viscosity of a porous formation in the earth communicating with the surface of the earth through a well bore comprising:

means for abruptly perturbing fluid from the head of the well bore to induce inertial oscillation in the fluid, wherein said inertial oscillations extend to the head of the well bore and propagate at the speed of sound in the fluid;

means for measuring resulting inertial pressure oscillations at one point in the well bore; and means for determining at least two such properties of the porous formation from the measured inertial pressure oscillations.

44. A method for determining a property such as permeability, porosity, storativity, thickness, and pore fluid viscosity of a subsurface porous formation in the earth communicating with the surface of the earth through a well bore comprising the steps of:

(a) abruptly perturbing a fluid in the well bore from a head of the well bore to induce inertial oscillations of pressure in the fluid at a plurality of frequencies, said inertial oscillations extending between the head of the well bore and the porous formation and propagating in the fluid at the speed or sound;

(b) measuring the inertial oscillations at the plurality of frequencies at at least one point in the well bore between the head of the well bore and the porous formation; and (c) determining at least one such property of the porous formation from the measured inertial oscillations.

45. The method of claim 44, wherein the step of perturbing comprises using a steady forcing function swept over the plurality of frequencies, thereby inducing undamped oscillations of pressure.

46. The method of claim 44, wherein the step of determining includes the step of using a numerical model of fluid flow in the porous formation that satisfies conditions of mass and momentum conservation.

47. The method of claim 44, wherein the step of determining includes using amplitudes and the frequencies of the oscillations measured at the plurality of frequencies.

48. A method of determining properties such as permeability, porosity, storativity, thickness, and pore fluid viscosity of a fluid system including a porous formation in the earth communicating with the surface of the earth through a well bore comprising the steps of:

abruptly perturbing fluid in the well bore from a head of the well bore, causing rapid oscillations in the fluid at frequencies greater than or equal to a fundamental frequency of the fluid system, including transient flow characterized by inertial flow oscillations propagating in the fluid at the speed of sound, measuring the pressure of the rapid oscillations in the fluid, and determining inertial flow effects in the fluid from decay of the rapid oscillations, thereby determining at least one such property.

* * * * *